United States Patent [19]

Pherigo, Jr.

[11] Patent Number: 5,019,798

[45] Date of Patent: May 28, 1991

[54] OVERHEAD WARNING DEVICE

[76] Inventor: Wayne H. Pherigo, Jr., 709 Pauline, Pasadena, Tex. 77502

[21] Appl. No.: 470,595

[22] Filed: Jan. 26, 1990

[51] Int. Cl.[5] ..... G08B 7/06

[52] U.S. Cl. ..... 340/326; 340/321; 340/473

[58] Field of Search ..... 340/326, 321, 815.18, 340/815.21, 815.22, 473, 474, 908; 362/398

[56] References Cited

U.S. PATENT DOCUMENTS

| | | | |
|---|---|---|---|
| 3,056,954 | 10/1962 | Jorritsma | 340/321 |
| 3,461,448 | 8/1969 | Kramer | 340/326 |
| 3,622,979 | 11/1971 | Dickerson | 340/321 X |
| 4,090,185 | 5/1978 | Patty | 340/321 |
| 4,229,781 | 10/1980 | Hitora | 340/473 X |
| 4,241,332 | 12/1980 | Farque | 340/326 |
| 4,288,784 | 9/1981 | Fusco | 340/326 |
| 4,468,656 | 8/1984 | Clifford et al. | 340/321 X |
| 4,633,215 | 12/1986 | Anders et al. | 340/473 |
| 4,875,028 | 10/1989 | Chou | 340/473 |

FOREIGN PATENT DOCUMENTS

| | | | |
|---|---|---|---|
| 2720972 | 11/1978 | Fed. Rep. of Germany | 340/321 |

*Primary Examiner*—Joseph A. Orsino
*Assistant Examiner*—Brian R. Tumm
*Attorney, Agent, or Firm*—Robert A. de Groot; Stephen A. Gratton

[57] ABSTRACT

A warning device that is removably affixed to overhead loads which are moved by an overhead crane. The warning device has a rotating beacon light and a horn, both activated by a switch and powered by internal batteries. The device is attached to steel loads with magnets or to non-metallic loads with straps and is activated whenever the load is raised and in motion. The device is removed from the when the load arrives at its destination load and is then stored by attaching the device to the crane hook with a safety cable.

6 Claims, 1 Drawing Sheet

OVERHEAD WARNING DEVICE

BACKGROUND OF THE INVENTION

This invention relates to a removably attachable warning device for securement to the underside of a load. In a preferred embodiment, the warning device is magnetically affixed to the load after it has been raised by an overhead crane but prior to moving a substantial distance. The device is provided with a warning light beacon and a horn, each of which are battery powered.

The heavy industries i.e., manufacturing, shipping, steel-making, ship-building and the like, typically are provided with overhead cranes in their facilities for use either in the manufacturing or shipping/handling processes. Typical warning systems can include lights on a bridge crane cab located overhead, or lights and buzzers on the crane trolley of a gantry crane. In such cases there is no warning device located proximate the load being carried, and it is not uncommon that workmen on the ground or building floor are unaware of overhead travelling loads. Portions of overhead loads coming loose and falling to the ground pose a definite hazard and can cause serious if not fatal accidents to those unlucky enough to be located below.

In order to make the work place safer, the Occupational Safety and Health Administration (OSHA) has enacted various rules regarding cranes. 29 CFR 1910.179 requires that "except for floor-operated cranes a gong or other effective warning signal shall be provided for each crane with a power traveling mechanism". This rule is applicable to overhead and gantry cranes. 29 CFR 1910.261 requires "all cranes shall be equipped with a suitable warning device such as a horn or whistle" and 29 CFR 1917.45 states that "rail mounted cranes shall be equipped with an effective travel warning device which shall be used to warn employees who may be in the path of the moving crane."

While the requirements of these rules may be met by the conventional practice of placing the warning device on the crane itself, Applicant has determined that a far more effective warning device would be placed on the load itself, where it is much more likely to be seen and/or heard by workers beneath the load.

SUMMARY OF THE INVENTION

This invention consists of a removable and reusable warning device adapted to be affixed to the bottom or side of a load to be carried overhead by a crane. In a preferred embodiment, the device comprises an impact-resistant plastic housing containing batteries, an electric switch, a horn, an optional warning light, and an attachment means. Preferably, the device is provided with a magnetic base for affixation to a relatively flat steel surface and a safety cable for affixation to the load.

The housing of the device is provided with ports for passage of the horn sound and has provision for a rotating beacon light or pulsing light. The beacon light is also preferably housed in a transparent impact-resistant globe. The beacon and horn may be activated either separately or at the same time by the on/off electric switch mounted on the housing adjacent the beacon light. The batteries can be replaceable or rechargeable and are contained within the housing adjacent the magnetic base.

In the event there is not a flat metallic surface for affixation with the magnetic base, optionally provided straps may secure the device to the load. In any event, it is desirable to affix the safety strap loop to the load (or looped over the crane hook) during load-moving operations to ensure that the warning device does not cause injury should it become detached from the load. When the load is removed from the hook, the warning device is removed from the load and the safety strap loop is attached to the crane hook, with the device turned off until ready for a next load.

DETAILED DESCRIPTION OF THE INVENTION

Figure 1:
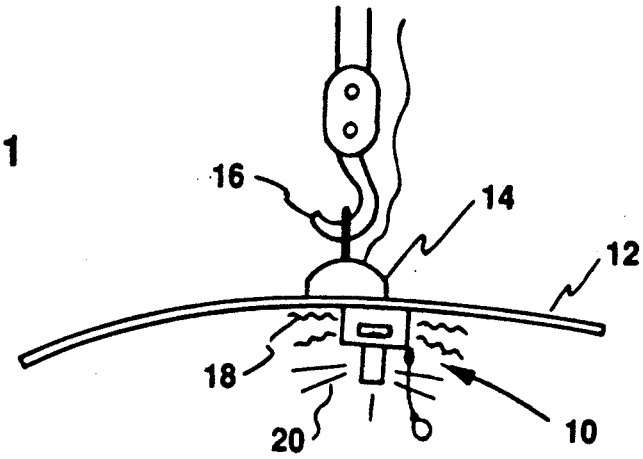
FIG. 1 is a partial elevational view of a crane hook, load and the warning device of the present invention.

FIG. 1 illustrates the overhead warning device 10 of the present invention magnetically clamped to a steel sheet 12 which is in turn held by an electromagnet 14 suspended from crane hook 16. It is to be appreciated that while the device 10 is described herein with attachment means in the form of magnets, other means may be utilized when the device 10 is to be affixed to non-metallic loads. For example, the device may be provided with straps, chains or any other means reasonably apparent to one skilled in this art. As illustrated, the internal horn, or sound-generating means, emits sounds at 18 and beam 20 flashes to warn workers below of overhead load location.

Figure 2:
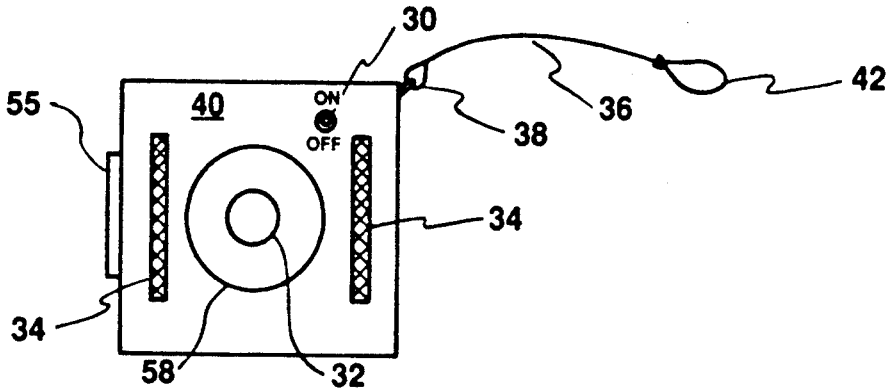
FIG. 2 is a plan view of the present invention.
Figure 3:
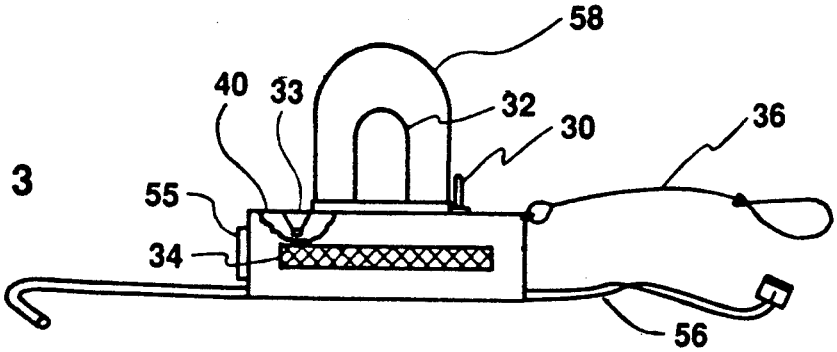
FIG. 3 is an elevation view having a cut-away section of the present invention.

The device is illustrated in greater detail in FIGS. 2 and 3. The on/off switch 30 activates the horn and/or the beacon light 32. Alternatively, separate on/off switches may be provided for each of the horn and the beacon light. The horn 33 emits sound through a plurality of ports 34. Safety cable 36 is provided with a first end 38 attached to housing 40 and a second end having a loop 42. When not affixed to a load, the loop 42 of cable 36 is attached to the crane hook 16 and the device 10 is deactivated by turning off switch 30.

Figure 4:
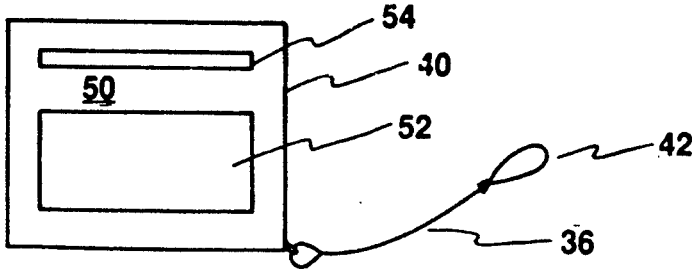
FIG. 4 is a bottom view of the present invention.

FIG. 4 illustrates the base 50 of housing 40, having thereon at least one magnet 52 and a battery compartment 54 having a plurality of batteries therein. A charging connection (not shown) may also be included if rechargeable batters are utilized. The magnet 52 must be sized so as to provide sufficient holding power to maintain the device 10 affixed to the underside of a load. Magnets may be provided on the sides as at 55 of the housing 40 in addition to the bottom 50.

If the load is nonmagnetic or does not have sufficient flat surface to ensure attachment with magnets, the device may be provided with straps 56 to secure the device to a load. Alternatively, the device can be suspended by safety cable 36 from a protrusion on the load or from the crane hook by using loop 42.

Although the figures illustrate a device comprising both a horn and a light, an alternative embodiment consists of a device having a horn or gong only, thereby decreasing the load on the batteries. Additionally, a pulsing aircraft-type light can be utilized in lieu of the rotating beacon in order to conserve battery power.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

In a preferred embodiment, the device is provided in the form of a high-impact resistant plastic housing, with a transparent impact-resistant globe 58 enclosing the beacon light 32. The device is intended for affixation to the underside of a load, but may be affixed to a side of the load, preferably the side facing the direction of travel.

I claim:

1. An overhead warning device for affixation to an overhead crane, said device comprising:

a. a housing;

b. battery means within said housing;

c. a horn within said housing;

d. a 360° rotatable beacon lamp exterior of said housing;

e. electrical switch means mounted on said housing to activate or deactivate the horn and the lamp;

f. magnetic means on a side of the housing to affix the device to a metallic load; and g. a safety cable to affix the device to the load or the crane wherein the safety cable has a first end attached to the housing and a second end having a loop, and whereby said horn and the beacon lamp may be activated by the switch means to provide a warning function during operation of the overhead crane.

2. The device as recited in claim 1, wherein the battery means is rechargeable.

3. The device as recited in claim 1, wherein the housing is provided with at least one port in the housing to permit passage of the horn sound waves through the housing.

4. An overhead warning device for affixation to an overhead crane comprising:

a. a housing;

b. a 360° rotatable beacon lamp attached to said housing;

c. battery means within said housing;

d. a horn within said housing;

e. an electrical switch mounted on said housing to activate or deactivate the horn and the lamp;

f. magnetic means on a base of the housing that clamps the device to iron or steel; and g. a safety cable attached to the device wherein the safety cable has a first end attached to the housing and a second end having a loop to affix the device to a load or the crane, and whereby said horn and the beacon lamp may be activated by the switch to provide a warning function during operation of the overhead crane.

5. The device as recited in claim 4, wherein the housing is provided with at least one port in the housing to permit passage of the horn sound waves through the housing.

6. The device as recited in claim 4, wherein the battery means is rechargeable.

* * * * *